US010350560B2

(12) United States Patent
Lu

(10) Patent No.: US 10,350,560 B2
(45) Date of Patent: Jul. 16, 2019

(54) SEPARATED DECANTER

(71) Applicant: Dongguan Kinyet Metal Products Co., Ltd., Dongguan (CN)

(72) Inventor: Yungchang Lu, Dongguan (CN)

(73) Assignee: Dongguan Kinyet Metal Products Co., Ltd., Dongguan (CN)

( * ) Notice: Subject to any disclaimer, the term of this patent is extended or adjusted under 35 U.S.C. 154(b) by 188 days.

(21) Appl. No.: 15/497,440

(22) Filed: Apr. 26, 2017

(65) Prior Publication Data

US 2018/0311628 A1 Nov. 1, 2018

(51) Int. Cl.

| | |
|---|---|
| ***B01F 13/08*** | (2006.01) |
| ***B65D 1/06*** | (2006.01) |
| ***B65D 1/02*** | (2006.01) |
| ***B01F 3/04*** | (2006.01) |
| ***A47G 23/02*** | (2006.01) |
| ***B01F 13/00*** | (2006.01) |

(52) U.S. Cl.

CPC ..... *B01F 13/0818* (2013.01); *A47G 23/0241* (2013.01); *B01F 3/04794* (2013.01); *B01F 13/0022* (2013.01); *B65D 1/023* (2013.01); *B65D 1/06* (2013.01); *A47G 2400/045* (2013.01); *B01F 2215/0072* (2013.01)

(58) Field of Classification Search

CPC ..... B01F 13/0818; B01F 13/0022; B01F 3/04794; B01F 2215/0072; A47G 23/0241; B65D 1/023; B65D 1/06

See application file for complete search history.

(56) References Cited

U.S. PATENT DOCUMENTS

| | | | | |
|---|---|---|---|---|
| 2,940,738 | A * | 6/1960 | Posener | A47J 43/046 241/282.1 |
| 3,376,878 | A * | 4/1968 | Shoemaker | A61C 17/036 134/183 |
| 5,425,579 | A * | 6/1995 | Sampson | B01F 7/162 366/130 |
| 5,911,504 | A * | 6/1999 | Schindlegger, Jr. | A47J 43/04 366/197 |
| 6,283,605 | B1 * | 9/2001 | Kalamaras | A47G 19/2227 362/101 |
| 6,332,706 | B1 * | 12/2001 | Hall | B01F 3/04794 261/83 |
| 6,334,271 | B1 * | 1/2002 | Su Yeh | G09F 19/02 220/62.14 |

(Continued)

*Primary Examiner* — Stephen Hobson
(74) *Attorney, Agent, or Firm* — Wayne & Ken LLC; Tony Hom

(57) ABSTRACT

The invention relates to decanters technology field, more particularly relates to a separated decanter. A separated decanter includes a bottle body, a base and a motor sub-assembly; the bottom of the bottle body protrudes an annular wall, a spacer is provided in the annular wall, the spacer is provided with through holes to connect the lumen of the bottle body; the base includes a base surface, an outer ring and an inner ring; the outer ring is set at the outside peripheral of the base surface, the inner ring lies in the outer ring on the base surface; the annular wall connects with the inner ring, both of them and combine with the spacer to form a cavity; the cavity contains a magnet; the motor sub-assembly is set under the base; the motor sub-assembly drives the magnet to turn, thereby stirring the liquid in the bottle body.

9 Claims, 6 Drawing Sheets

(56) References Cited

U.S. PATENT DOCUMENTS

| | | | | |
|---|---|---|---|---|
| 7,364,348 | B1 * | 4/2008 | Jones | A47J 43/042 366/130 |
| 9,873,097 | B1 * | 1/2018 | Dushine | B01F 13/0818 |
| 9,874,388 | B2 * | 1/2018 | Prosise | F25D 3/08 |
| 2002/0196705 | A1 * | 12/2002 | Jersey | A47J 43/0465 366/274 |
| 2004/0190372 | A1 * | 9/2004 | Goodwin | B01F 13/0818 366/273 |
| 2014/0334249 | A1 * | 11/2014 | Radow | B01F 13/0818 366/273 |
| 2015/0329809 | A1 * | 11/2015 | Cifaldi | B01F 13/0818 426/474 |
| 2018/0049571 | A1 * | 2/2018 | Lu | A47G 23/0241 |

* cited by examiner

SEPARATED DECANTER

FIELD OF THE INVENTION

The invention relates to decanters technology field, more particularly relates to a separated decanter.

BACKGROUND OF THE INVENTION

As the improvement of people's living standard, it becomes a fashionable and healthy life style to drink red wine. The red wine needs to be decanted before drink. At present market, in all of the decanters, the bottle body and the base contained a motor sub-assembly under the bottle body are set as a whole. However, the decanter is too heavy to take up and put down, and it is difficult to wash the bottle body.

SUMMARY OF THE INVENTION

To overcome the above shortcomings, the present invention provides a separated decanter, which includes a bottle body, a base and a motor sub-assembly. The bottle body and the base can be separated, it is convenient to disassemble and install. The bottle body is easy to wash and the structure of the decanter is simple.

The technologies in the present invention are as follows: A separated decanter includes a bottle body, a base and a motor sub-assembly; the bottom of the bottle body protrudes an annular wall, a spacer is provided in the annular wall, the spacer is provided with through holes to connect the bottle body; the base includes a base surface, an outer ring and an inner ring; the outer ring is set at the outside peripheral of the base surface, the inner ring lies in the outer ring upon the base surface; the inner ring is connected with the annular wall, both of the inner ring and the annular wall combine with the spacer to form a cavity; the cavity contains a magnet; a motor sub-assembly is set under the base; the motor sub-assembly drives the magnet to turn, thereby stirring the liquid in the bottle body.

A seal ring is set in the inner of the inner ring on the base surface.

The middle of the base surface protrudes upwards to form a convex platform, between the convex platform and the inner ring forms an annular groove, where contains the seal ring.

The outside wall of the annular wall and the inner wall of the inner ring respectively sets threads matching each other.

The spacer is in the shape of an groove, the groove is arranged at the annular wall, the bottom of the groove is provided with the through holes.

A few stiffeners are set between the outer ring and the inner ring to connect the outer ring and the inner ring.

The outer ring opens outward in the shape of a trumpet.

The bottle body has a round belly in the middle and a neck in the top.

The separated decanter also includes another seal ring outside the inner ring on the bottom of the bottle body, which seals the space between the bottle body and the outer ring.

The separated decanter in the present invention has the follow advantages: the separated decanter includes a bottle body, a base and a motor sub-assembly under the bottle body; the bottle body and the base can be separated, it is convenient to disassemble and install. The bottle body is easy to wash and the structure of the decanter is simple.

DETAILED DESCRIPTION OF ILLUSTRATED EMBODIMENTS

The follows will further descript the present invention with the embodiments, which are the preferable embodiments in the present invention.

Figure 1:
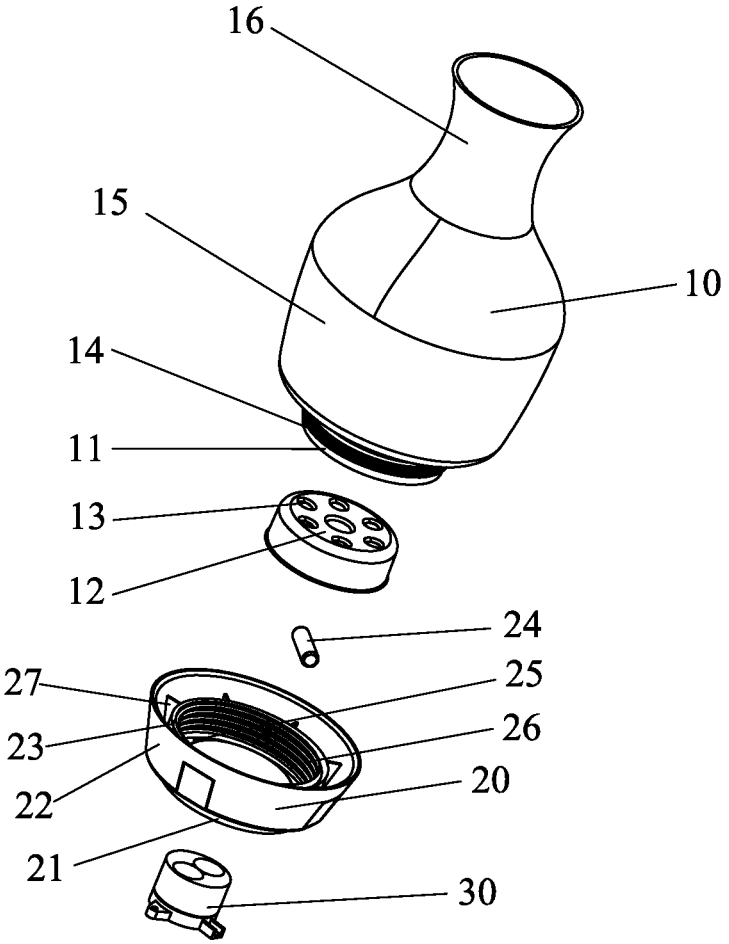
FIG. 1 is a schematic view of the separated decanter in present invention.
Figure 2:
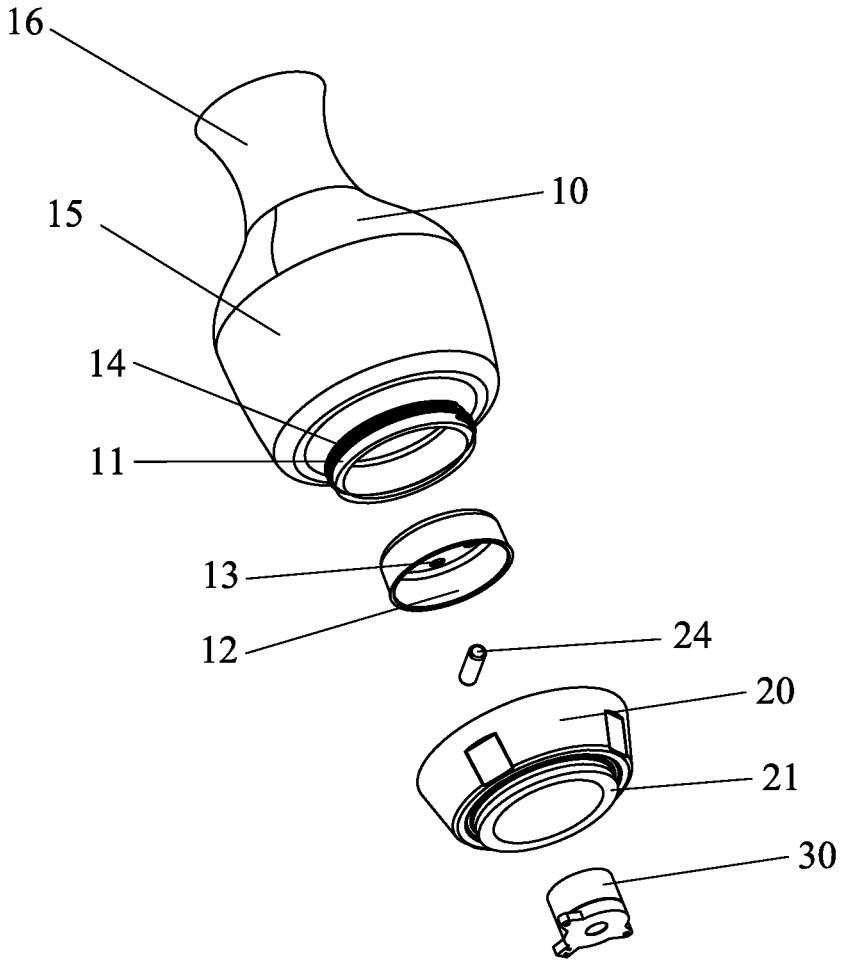
FIG. 2 is another schematic view of the separated decanter in present invention.
Figure 4:
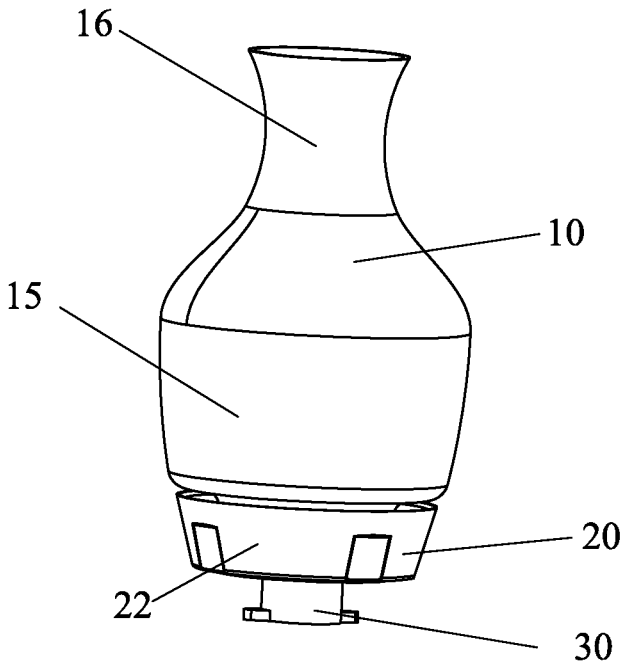
FIG. 4 is a composite structure schematic view of the separated decanter showed in FIG. 1 and FIG. 2 in present invention.

Referring FIG. 1, FIG. 2 and FIG. 4, a separated decanter includes a bottle body 10, a base 20 and a motor sub-assembly 30. The base 20 is set under the bottle body 10, the motor sub-assembly 30 is set under the base 20.

The bottom of the bottle body 10 downwardly protrudes an annular wall 11, a spacer 12 is provided in the inner of the annular wall, the spacer 12 has through holes 13 to connect the bottle body 1.

The base 20 includes a base surface 21, an outer ring 22 and an inner ring 23; the outer ring 22 is set at the outside peripheral of the base surface 21, the inner ring 23 lies in the outer ring 22 on the base surface21; the inner ring 22 and the annular wall 11 match each other, the inner ring 22 connects the annular wall 11, both of the inner ring 22 and the annular wall 11 combine with the spacer 12 to form a cavity; the cavity contains a magnet 24.

A motor sub-assembly 30 is set under the base 20; the motor sub-assembly 30 drives the magnet 24 to turn, thereby stirring the liquid in the bottle body 10.

Preferably, in order to avoid the liquid leaking from the bottle body 10, a seal ring 25 is set in the inner of the inner ring 23 on the base surface 21. The annular wall 11 and the seal ring 25 connect in sealing.

Figure 3A:
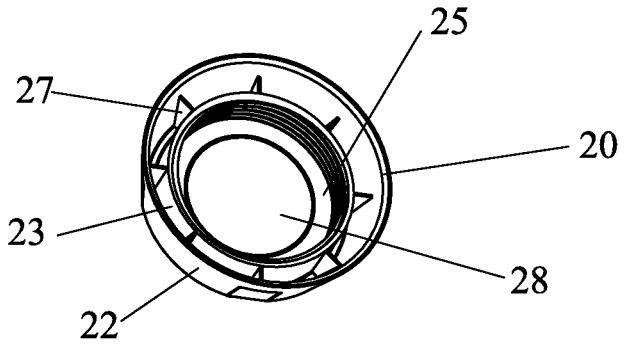
FIG. 3A is a schematic view of the base of the separated decanter in present invention.
Figure 3B:
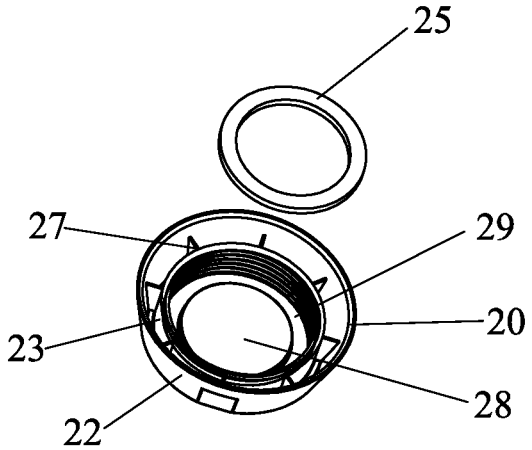
FIG. 3B is another schematic view of the base of the separated decanter in present invention.

Referring FIG. 3A and FIG. 3B, the middle of the base surface 21 protrudes upwards to form a convex platform 28, between the convex platform 28 and the inner ring 23 forms an annular groove 29, where contains the seal ring 25.

Preferably, the outside wall of the annular wall 11 and the inner wall of the inner ring 23 respectively sets inner threads 14 and outer threads 26 matching each other. The bottle body 10 and the base 20 are connected by the inner threads 14 and the outer threads 26. The bottle body 10 disassembles from the base 20 when it needs to be washed. It is convenient to use.

Preferably, the spacer 12 is in the shape of an groove, the groove is arranged at the annular wall 11. The bottom of the groove is provided with the through holes 13.

Preferably, a few stiffeners 27 are set between the outer ring 22 and an inner ring 23 and connect the outer ring 22 and an inner ring 23. The stiffeners 27 strengthen the connection of the outer ring 22 and an inner ring 23.

Preferably, an outer ring 22 opens outward in the shape of a trumpet. The shape of the separated decanter looks beautiful.

Preferably, the bottle body 10 has a round belly 15 in the middle and a neck 16 in the top. The round belly 14 can contain liquid, and the neck 16 is convenient to take and put the bottle body 10.

Figure 5A:
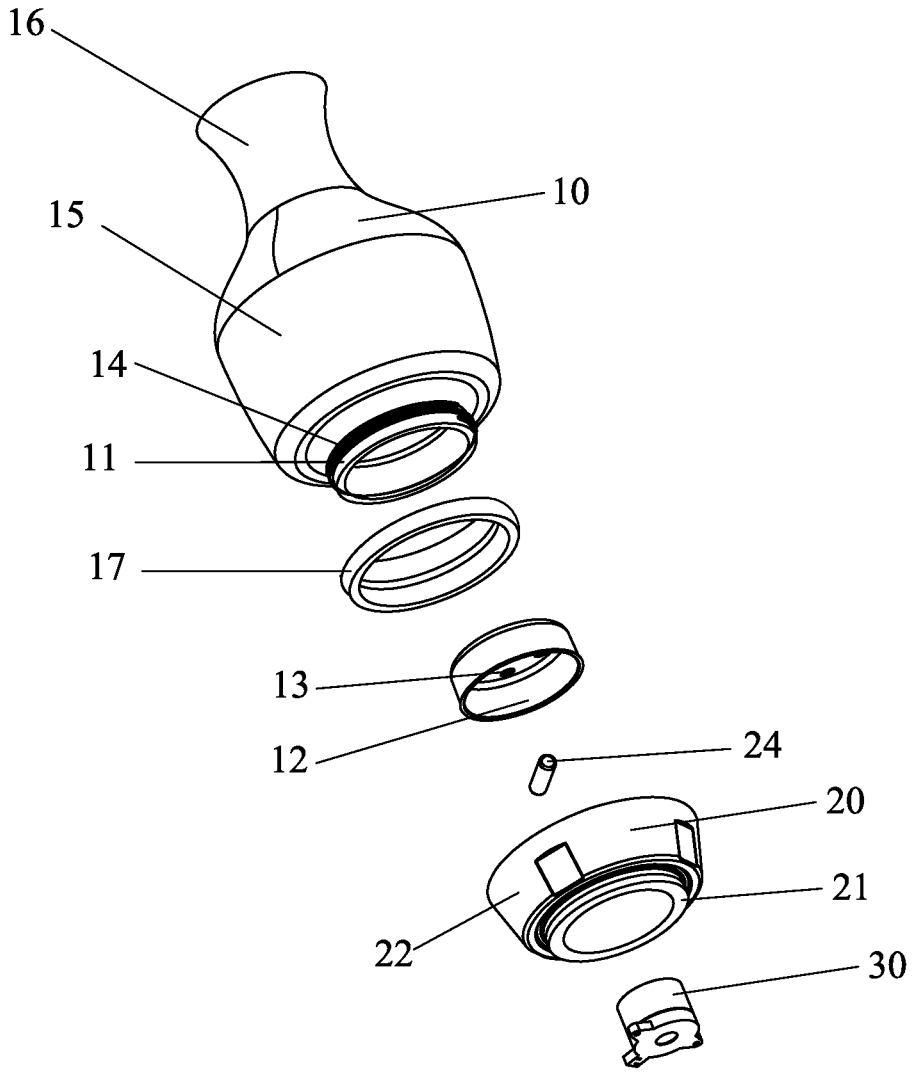
FIG. 5A is another schematic view of the base of the separated decanter in present invention.
Figure 5B:
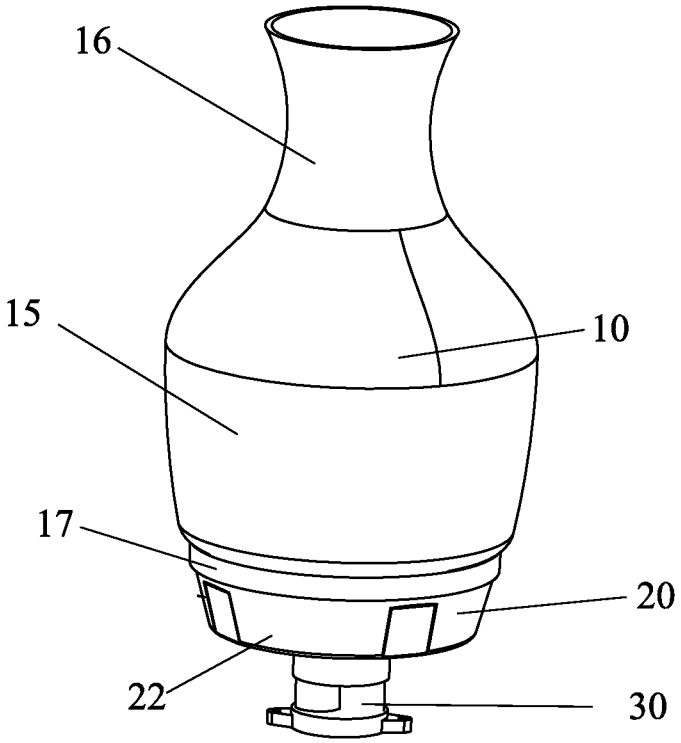
FIG. 5B is a composite structure schematic view of the separated decanter showed in FIG. 5A in present invention.

Referring FIG. 5A and FIG. 5B, the separated decanter also includes another seal ring 17 outside the inner ring on the bottom of the bottle body, which seals the space between the bottle body and the outer ring.

While the specification has described in detail certain exemplary embodiments, it will be appreciated that those skilled in the art, upon attaining an understanding of the foregoing, may readily conceive of alterations to, variations of, and equivalents to these embodiments. The foregoing preferred embodiments of the present invention are illustrated of the present invention rather than limiting of the present invention. It is intended to cover various modifications and changes included within the spirit and scope of the appended claims, the scope of which should be accorded the broadest interpretation so as to encompass all such modifications and similar structures.

I claim:

1. A separated decanter includes a bottle body, a base and a motor sub-assembly; wherein at the bottom of said bottle body protrudes an annular wall, a spacer is provided in said annular wall, said spacer is provided with through holes to connect said bottle body; said base includes a base surface, an outer ring and an inner ring; said outer ring is set at the outside peripheral of said base surface, said inner ring lies in said outer ring on said base surface; said annular wall connects with said inner ring, said annular wall and said inner ring combine with said spacer to form a cavity; said cavity contains a magnet; said motor sub-assembly is set under said base; said motor sub-assembly drives said magnet to turn, thereby stirring liquid in said bottle body.

2. The separated decanter according to claim 1, wherein a seal ring is set in the inner of said inner ring on said base surface.

3. The separated decanter according to claim 2, wherein the middle of said base surface upwardly protrudes to form a convex platform, between said convex platform and said inner ring forms an annular groove, where contains said seal ring.

4. The separated decanter according to claim 1, wherein the outside wall of said annular wall and the inner wall of said inner ring respectively sets threads matching each other.

5. The separated decanter according to claim 1, wherein the spacer is in the shape of a groove, said groove is arranged at said annular wall, the bottom of said groove is provided with said through holes.

6. The separated decanter according to claim 1, wherein a few of stiffeners are set between said outer ring and said inner ring to connect said outer ring and said inner ring.

7. The separated decanter according to claim 1, wherein said outer ring opens outward in the shape of a trumpet.

8. The separated decanter according to claim 1, wherein said bottle body has a round belly in the middle and a neck in the top.

9. The separated decanter according to claim 1, wherein said separated decanter also includes another seal ring outside said inner ring on the bottom of said bottle body, which seals the space between said bottle body and said outer ring.

* * * * *